United States Patent [19]

Lamb

[11] 3,965,979

[45] June 29, 1976

[54] ORIENTING SYSTEM FOR A KICKOVER TOOL

[75] Inventor: C. Paul Lamb, Garland, Tex.

[73] Assignee: Teledyne, Inc., Garland, Tex.

[22] Filed: Feb. 12, 1975

[21] Appl. No.: 549,168

[52] U.S. Cl. ..... 166/117.5

[51] Int. Cl.[2] ..... E21B 7/06

[58] Field of Search ..... 166/117.5; 175/79, 80, 175/81

[56] References Cited

UNITED STATES PATENTS

| | | | |
|---|---|---|---|
| 3,727,683 | 4/1973 | Terral et al. | 166/117.5 |
| 3,796,259 | 3/1974 | Outhouse | 166/117.5 |
| 3,827,489 | 8/1974 | McGowen | 166/117.5 |
| 3,827,490 | 8/1974 | Moore et al. | 166/117.5 |
| 3,876,001 | 4/1975 | Goode | 166/117.5 |
| 3,891,032 | 6/1975 | Tausch et al. | 166/117.5 |

*Primary Examiner*—Ernest R. Purser
*Assistant Examiner*—Richard E. Favreau
*Attorney, Agent, or Firm*—Vinson, Elkins, Searls, Connally & Smith

[57] ABSTRACT

An orienting system for a kickover tool to permit the installation and/or removal of well equipment from a side pocket mandrel. The system includes a double orienting means to position the kickover tool in a non-aligned position as the tool moves downwardly and in an aligned position as the tool moves upwardly and a single key on the kickover tool to engage each of the orienting means. This abstract is neither intended to define the invention of the application which, of course, is measured by the claims, nor is it intended to be limiting as to the scope of the invention in any way.

14 Claims, 6 Drawing Figures

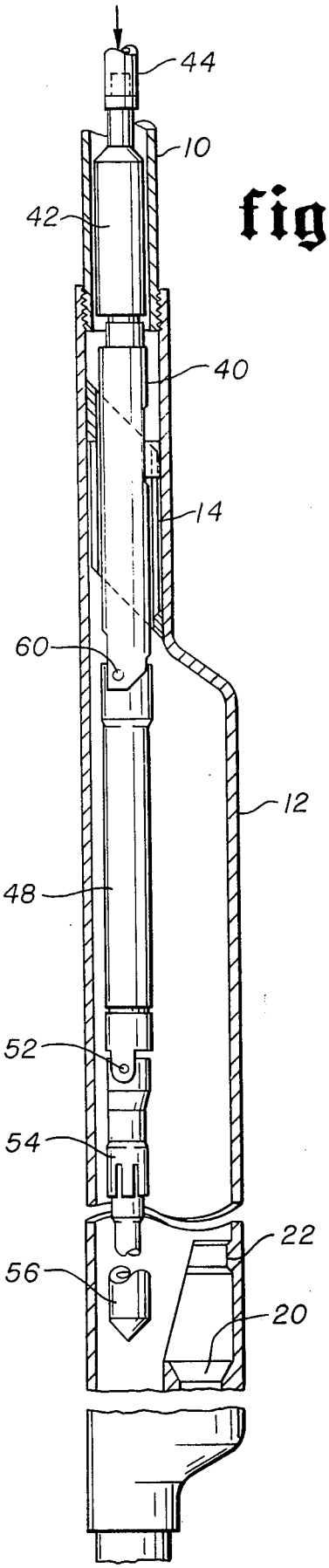
fig. 1
fig. 2
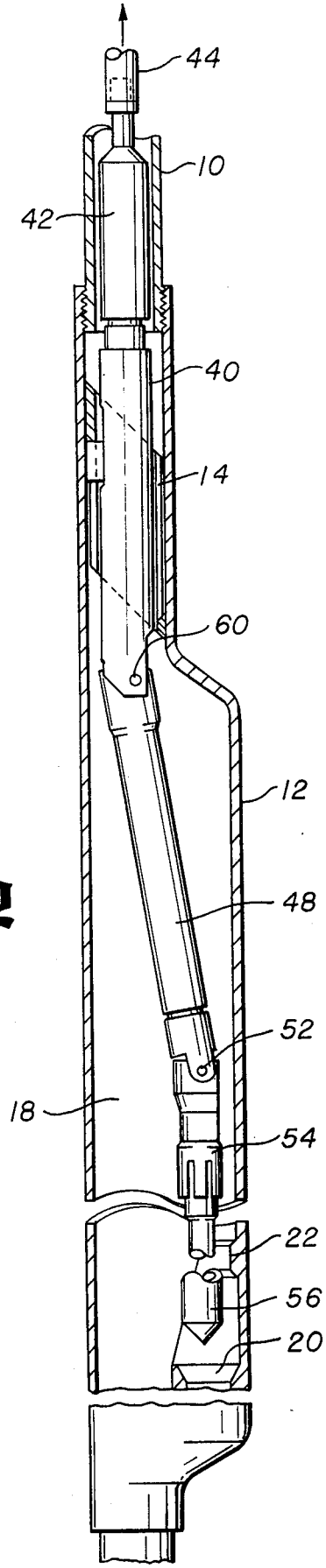

ORIENTING SYSTEM FOR A KICKOVER TOOL

BACKGROUND OF THE INVENTION

1. Field of the Invention

This invention relates to an orientation system for well kickover tools and more particularly to an orientation system which orients the kickover tool into an aligned position so that it cannot articulate into the side pocket of a side pocket mandrel when the tool is lowered but orients the tool so that it can be articulated into the side pocket when the tool is raised.

2. The Prior Art

A major problem in the operation of kickover tools arises when the well is deviated at a substantial angle. In a deviated string of tubing the side pocket of a side pocket mandrel may be positioned above the central axis of the tubing or it may be positioned below the central axis of the tubing. If the side pocket is located above the central axis of the tubing, the kickover tool must be powerful enough to resist the force of gravity and kick up into the side pocket. On the other hand, when it is desired to bypass a side pocket mandrel which has its side pocket below the central axis of the tubing, the kickover tool must maintain its aligned condition and not drop down into the side pocket.

U.S. Pat. No. 2,942,671 to Schramm attempts to solve these problems by locating an orienting sleeve with a single orienting guide surface in the side pocket mandrel and by providing the kickover tool with an orienting key. In a string of tubing, the orientation of the orienting sleeve in each of several side pocket mandrels is different. The disclosed kickover tool will only articulate in one direction. When the tool is lowered in the tubing the orienting key engages the orienting sleeve guide surface to orient the tool. If it is desired to by-pass the side pocket of a particular side pocket mandrel, the tool carrier of the kickover tool will be oriented to impinge against the wall of the mandrel, but if it is desired to kick the kickover tool into the side pocket, the kickover tool will be oriented to articulate into the side pocket. With the Schramm system the various orientations of the orienting sleeve require the keeping of precise records as well tools may be run a substantial time after the tubing is set. Also the system requires a large inventory of different mandrels as well as different kickover tools.

U.S. Pat. No. 2,948,341 to Fredd discloses an orienting sleeve with orienting guide surfaces at both ends. The kickover tool is oriented for articulation into the side pocket by the guide surfaces both when the tool is lowered through the tubing and when the tool is raised in the tubing to be articulated into the side pocket. No provision is made to prevent the tool from falling into a side pocket while it is being lowered in the tubing.

U.S. Pat. No. 3,727,683 to Terrel, et al discloses a kickover tool orienting system comprising an orienting sleeve with orienting guide surfaces at both ends, two orienting keys on the kickover tool, and a side pocket mandrel wherein the side pocket is located in alignment with the upper tubing bore while the bore of the mandrel is not aligned with the upper tubing bore. The Terrel, et al system has several disadvantages: First, the arrangement of the two orienting keys on the kickover tool increases the likelihood that the tool will become hung up in the tubing before it is desired to set the tool. Second, with the side pocket being aligned with the upper tubing bore and the mandrel being non-aligned, the possibility of other articles engaging the side pocket when they are lowered through the tubing is increased. Further the non-aligned bore through the mandrel will prevent running of some tools such as a wash pipe.

OBJECTS OF THE INVENTION

It is an object of this invention to provide a kickover tool orienting system that can orient the kickover tool in different orientations as the tool is moved in different directions, even though the kickover tool has a single orienting key.

It is an additional object of this invention to provide a kickover tool orienting system that utilizes a single kickover tool having a single orienting key and a single form of side pocket mandrel in which the tool is oriented away from the pocket when running in and oriented to register with the pocket when the tool is raised in a well.

Another object is to provide a kickover tool with a single key which will pass obstructions when running in the hole but will cooperate with orienting means to orient the tool when moving in both directions in a tubing and in which the setting shoulder of the key becomes inoperative upon application of a selected force.

Another object is to provide a side pocket mandrel having a pair of orienting means spaced angularly in the mandrel to differently orient a kickover tool with a single orienting key as it passes through the mandrel in opposite directions.

These and other objects and features of advantage of this invention will become apparent from the drawings, the claims and the detailed description which follows.

BRIEF DESCRIPTION OF THE DRAWINGS

In the drawings wherein like numerals indicate like parts, and wherein an illustrative embodiment of this invention is shown, FIG. 1 is a longitudinal view partially in section and partially in elevation showing a side pocket mandrel with its associated orienting means and a kickover tool being lowered through the mandrel, FIG. 2 is a longitudinal view partially in section and partially in elevation of a side pocket mandrel with its associated orienting means and a kickover tool being articulated into the side pocket of the mandrel.

DESCRIPTION OF THE PREFERRED EMBODIMENT

Figure 3:
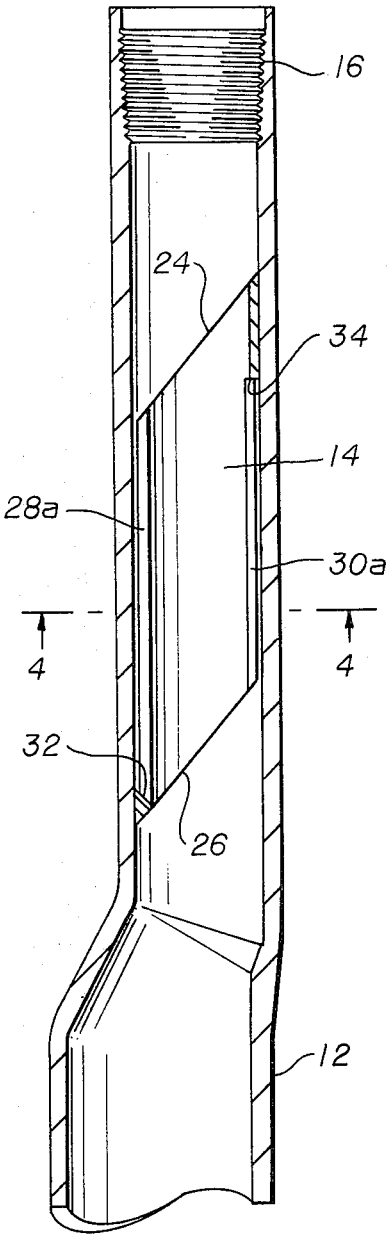
FIG. 3 is a vertical view in section of a portion of a side pocket mandrel and its associated orienting means.

A tubing string 10 is normally run with a plurality of side pocket mandrels, such as mandrel 12, at spaced points along the tubing 10 when the well is to be equipped for gas lift and other purposes. The tubing 10 will be in a casing of a well for producing fluids. For simplicity of illustration, the well casing and well are not shown.

The side pocket mandrel 12 may take any desired form, such as the conventional mandrel shown, except for the orienting means 14. The mandrel 12 will have means, such as threads 16, at its upper and lower extremities for connection to the well tubing 10. Through the mandrel 12 will be a bore 18 through which well operations will be conducted. In the side pocket of the mandrel 12 will be means for receiving well flow control equipment such as valves. The receiving means may be a suitable valve receiver 20 and a shoulder 22 to cooperate with a suitable latch which will maintain the well flow control equipment in the side pocket of the mandrel 12.

Located in one of the end bores of the mandrel 12 will be the orienting means 14. The location of the orienting means 14 within the mandrel 12 and the location of the orienting key on the kickover tool should be such that the orienting key engages the orienting means 14 before the kickover tool can articulate into the side pocket of mandrel 12. If the orienting means 14 is in the upper bore of mandrel 12 and the orienting key is on the upper portion of a guideless kickover tool, then the tool should be short enough so that it cannot articulate into the side pocket before the key engages the orienting means. On the other hand, if the orienting means 14 is located in the bottom bore of the mandrel 12 and the orienting key is on a riding guide which extends below the tool carrier of the kickover tool as in McGowen U.S. Pat. No. 3,827,489, the guide should be long enough so that the key engages the orienting means 14 before the tool can articulate into the side pocket.

The orienting means 14 performs two orienting functions. First, when the kickover tool is being lowered in the tubing, the orienting means 14 orients the tool so that it cannot articulate into the side pocket of mandrel 12. Second, when the kickover tool is being raised in the tubing, the orienting means 14 orients the tool so that it can articulate into the side pocket of mandrel 12. To perform the two orienting functions, the orienting means 14 itself has two orienting means 24 and 26 so positioned with respect to each other that a kickover tool with a single orienting key will be oriented as indicated.

The orienting means is preferably provided by an annular elongate sleeve 14 in mandrel 12 having an axis coincident with the axis of mandrel 12. So that sleeve 14 does not reduce the effective diameter of the tubing, the bore portion of mandrel 12 in which sleeve 14 is located preferably has an internal diameter slightly in excess of the internal diameter of the tubing 10 and the sleeve 14 has an internal diameter equal to the internal diameter of the tubing 10. The upper and lower surfaces of sleeve 14 comprise the two orienting means 24 and 26 respectively. The upper surface 24 extends downwardly and toward the side pocket at a substantial angle and functions to orient a kickover tool into a position so that it cannot articulate into the side pocket of mandrel 12 on downward movement of the tool through the tubing 10. The lower surface 26 extends upwardly and away from the side pocket and functions to orient a kickover so it can articulate into the side pocket on upward movement of the tool. Thus in performing their respective orienting functions, the upper surface 24 provides a downwardly directed mule shoe guide surface while the lower surface 26 provides an upwardly directed mule shoe guide surface. The upper and lower surfaces 24 and 26 are engageable by a locator key of a kickover tool.

Once a kickover tool with a single locator key has been oriented in the desired orientation by either of the upper and lower surfaces 24 and 26 of sleeve 14, means are provided to maintain the kickover tool in the prescribed orientation as the key passes through the sleeve 14. Orientation maintaining means 28 engages the locator key of the kickover tool to maintain the kickover tool in a position where it is unable to articulate into the side pocket of mandrel 12, and orientation maintaining means 30 engages locator key to maintain the tool in a position where it can articulate into the side pocket. Orientation maintaining means 28 may be a vertical slot through sleeve 14 extending downwardly from the lower-most portion of the upper mule shoe guide surface 24. Similarly, orientation maintaining means 30 may be a vertical slot through sleeve 14 extending upwardly from the upper-most position of the lower mule shoe guide surface 26. In FIG. 3 one surface of vertical slot 28 is shown as **28*a* and one surface of vertical slot 30 is shown as 30*a*. Vertical slot 28 terminates before it reaches lower surface 26 so that a complete orienting means is provided by lower surface 26. Otherwise the possibility exists that when the tool is being raised through the tubing the locator key will not engage the lower surface 26 but will pass through sleeve 14 through slot 28. To prevent the orienting key from hanging up on the termination of slot 28, vertical slot 28 terminates at its lower-most end in chamfered surface 32. Vertical slot 30 is shown, in FIG. 3, terminating at its upper-most end in a downwardly directed stop shoulder 34. Stop shoulder 34 is square or normal to the axis of the sleeve 14, and provides means to engage the locator key of the kickover tool, in a manner to be hereinafter explained, to articulate the tool into the side pocket of side pocket mandrel 12.**

Although the upper and lower orienting surfaces 24 and 26 are shown as being parallel, and vertical slots 28 and 30 are shown as being in opposite sides of orienting sleeve 14, it is to be understood that the alignment of these surfaces and slots can be any alignment that will permit the surfaces and slots to perform their orienting functions and the slots need not be 180 degrees apart. The upper orienting surface 24 with its vertical slot 28 is oriented a sufficient angular distance from the lower orienting surface 26 with its vertical slot 30 so that when a kickover tool with a single locator key is lowered through the tubing 10 the engagement of the locator key with upper surface 24 and vertical slot 28 orients the kickover tool to impinge the tool carrier along the bore wall of side pocket mandrel 12. When the tool is raised through the tubing 10 the engagement of the locator key with lower surface 26 and vertical slot 30 orients the kickover tool to permit articulation of the tool carrier into the side pocket of mandrel 12.

To provide a kickover tool that cannot articulate into the side pocket of mandrel 12 after its locator key has been oriented by first orienting means 24 of orienting means 14 when the tool is being lowered in the tubing 10, and yet which can articulate into the side pocket after its locator key has been oriented by the second orienting means 26 when the tool is being raised, a modified version of the kickover tool disclosed in U.S. Patent Application Ser. No. 454,727 filed Mar. 27, 1974 now U.S. Pat. No. 3,876,001 issued Apr. 8, 1975 may be used. The kickover tool illustrated herein is identical to the tool described in said application except for the design of the locator key. Said patent application is incorporated herein by reference for all purposes and reference thereto may be made for a detailed description of the tool and its operation.

The kickover tool has a housing 40 which is attached at its upper end to a sub 42 for connection with wire line tools or pump down equipment 44 in the conventional manner. To articulate the tool, the housing 40 slidably carries a plunger element 46. Pivotally mounted, at pivot joint 60, on one of the housing 40 and the plunger element 46 is a tool carrier 48. Carried by the other of the housing 40 and the plunger 46 is a locator key 50. The tool carrier 48, is the member of the kickover tool that is articulated into the side pocket of mandrel 12. Since the function of the articulated kickover tool is to run or retrieve well equipment from valve receiver 20 of mandrel 12, tool carrier 48 has at its lower end connecting means, such as pivot joint 52, for attachment to an adaptor 54 which runs or retrieves tool 56.

The housing 40, the plunger element 46, the tool carrier 48, and the pivot joint 60, which connects the tool carrier 48 to one of the housing 40 and the plunger 46, cooperate to perform two functions. First, they only permit the tool carrier 48 to articulate in one direction; e.g., the tool carrier 48 has only one degree of freedom. Second, they operate to articulate the tool carrier 48. With a pivot pin 60 connecting the housing 40 and the carrier 48, the carrier 48 could swing in two directions. Limit means prevent the tool carrier 48 from swinging in one of those directions. The housing 40 has a lower, downward facing surface 62 to engage an upper, upward facing surface 64 of the carrier 48. The abutment of these two surfaces prevents the carrier 48 from being articulated in one direction beyond the aligned relationship of FIG. 1, but permits it to be articulated in the other direction to the FIG. 2 position. To articulate the carrier, the plunger 46 has an abutment surface 66 at its lower end which engages a complementary abutment surface 68 at the upper end of the tool carrier 48. In order for engagement of surface 66 with surface 68 to articulate the carrier 48, the point of engagement of surfaces 66 and 68 is laterally spaced from pivot joint 60. With such an arrangement upward movement of the housing 40, relative to the plunger 46 results in surfaces 66 and 68 engaging to pivot or articulate the tool carrier 48 about pivot joint 60 into its kicked over, articulated position. It should be apparent that if the carrier 48 is pivotally joined to the plunger 46, surfaces on the plunger 46 and the carrier 48 would cooperate to limit the carrier's articulation to one direction while surfaces on the housing 40 and the carrier 48 would articulate the carrier 48 when the housing 40 is moved upward with respect to the plunger 46.

Figure 5:
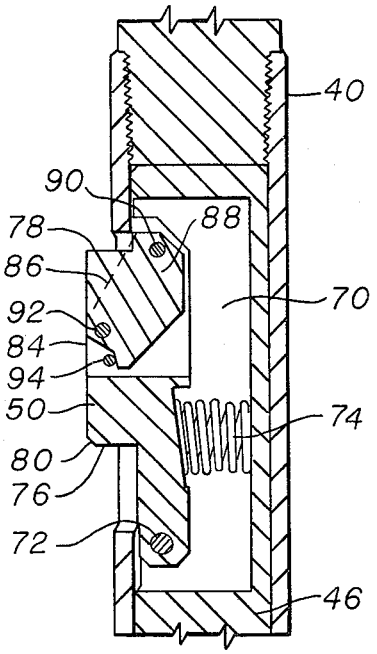
FIG. 5 is a longitudinal view partially in section and partially in elevation of a portion of a kickover tool and its orienting key.
Figure 4:
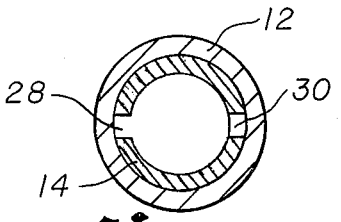
FIG. 4 is a vertical view in section taken along line 4—4 of FIG. 3.
Figure 6:
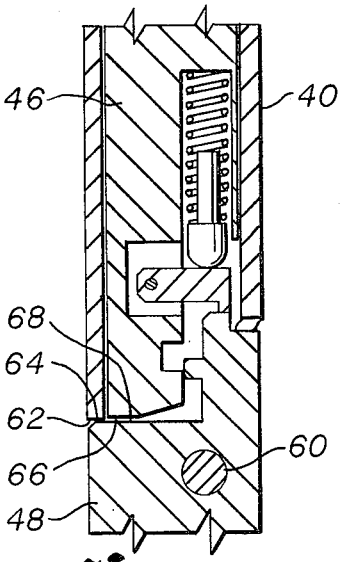
FIG. 6 is a longitudinal view partially in section and partially in elevation of a continuation of the view of the kickover tool shown in FIG. 5.

To provide for the upward movement of the housing 40 relative to the plunger 46, a locator and orienting key 50 is carried by the plunger 46. To prevent the key 50 from hanging up on obstructions, such as tubing couplings, as the tool is being lowered or raised in the tubing 10, and at the same time to permit the key 50 to perform its orienting and locating functions, the key 50 has means for resiliently urging a portion thereof to project beyond the outer surface of the housing 40 and yet which permit the key to be retracted within the housing 40. To accomplish these functions, key 50 is located in a window recess 70 of the plunger and housing 40. The key 50 is pivotally joined at one end to the plunger 46 by pin 72. Means for resiliently urging the key outward while permitting the key to be retracted within the recess 70 are provided by spring 74. The key 50 is provided with means to engage the orienting means 14. The engaging means on the key 50 may be a lower downward facing stop shoulder 76 and an upper upward facing abutment shoulder 78 both of which are on the portion of the key 50 projected beyond the housing 40. These shoulders extend perpendicular to the axis of the housing 40. Abutment shoulder 78 also engages the downward facing stop shoulder 34 in the sleeve 14 to permit movement of the housing 40 relative to the plunger 46 to articulate the kickover tool. Although it is necessary for stop shoulder 76 and abutment shoulder 78 to project far enough beyond the housing 40 so that they will engage the orienting means 14, it is also desirable that the key 50 have means for retracting it into recess 70 to pass other shoulders and obstructions in the tubing. For downward movement through the tubing, the retracting means is a lower chamfered surface 80 extending from lower stop shoulder 76 to the outer projecting edge 84 of the key 50. Chamfered surface 80 will ride over any obstructions in the tubing, forcing the key 50 to retract into the recess 70. The relationship of the width of the wall of sleeve 14 and chamfer 80 is selected such that with key 50 engaging the bore wall of mandrel 12 the shoulder 76 will engage the mule shoe guide surface 24. For upward movement through the tubing, the retracting means can be provided by having pin 72, which joins the key 50 to the plunger 46, be a shear pin in the conventional manner. Sufficient force will shear pin 72 and force key 50 into recess 70. A preferred alternative upward retracting means can be provided by chamfered surface 86 on key 50 and by having the abutment shoulder 78 be an abutment member 88 pivotally mounted on the upper portion of key 50 by pivot pin 90 and shear pin 92. Upward force will shear pin 92 and permit the abutment member 88 to swing inside recess 70. Chamfered shoulder 86 will retract the key into recess 70. To prevent abutment member 88 from swinging to the left of the position shown in FIG. 5 stop means, such as pin 94, are provided.

When the kickover tool is run downward through the tubing, chamfered surface 80 of key 50 will ride over any obstructions to retract the key into the recess 70 until the tool is run through the orienting means 14. Then shoulder 76 of the key 50 engages the upper guide surface 24 of the orienting means. Upon upward movement of the tool through the tubing 10, abutment shoulder 78 first engages the lower guide surface 26 of the orienting means and then engages stop shoulder 34. Further upward movement of the wireline tool or pump down equipment 44 will result in upward movement of the housing 40 relative to the plunger 46 as upward movement of the plunger 46 will be restricted. This relative movement of the housing 40 and plunger 46 will articulate the carrier 48 as aforementioned. The tool is then lowered to position or to remove a well tool 56 in the side pocket. Thereafter an upward force will retract the key 50 into recess 70 and permit the kickover tool to be removed from the tubing 10. It is apparent that if the plunger 46 had been pivotally attached to the carrier 48 instead of the housing 40; attaching the key to the housing 40 instead of the plunger 46, in the manner above-provided, will permit the tool to operate under the same principles as described.

The overall operation of this invention can now be appreciated. A kickover tool, as described, is run through a string of tubing 10. The tubing has several side pocket mandrels 12 located therein; each side pocket mandrel 12 having an orienting means 14. Chamfered surface 80 retracts key 50 into recess 70 of the tool so that the tool is not hung up when it is lowered through the tubing 10. When the tool is being lowered through a side pocket mandrel 12, stop shoulder 76 of the key 50 engages the first, upper guide means 24. The upper downwardly directed mule shoe guide surface 24 orients the key 50, and thus the tool, until the key 50 can slide down vertical slot 28. By passing down through vertical slot 28 the key 50, and thus the tool, maintains its orientation as it passes through the orienting means 14. The orientation provided to the tool by the engagement of the orienting key 50 with the first upper orienting means 24 is such that the tool carrier 48 cannot articulate into the side pocket of mandrel 12. In this manner the tool is lowered through the tubing to any desired depth. The tool is then pulled upward in the tubing to articulate it. When the tool reaches the side pocket mandrel 12, abutment shoulder 78 engages the lower guide means 26. This upwardly directed mule shoe guide surface 26 orients the key 50 until the key 50 can run up into vertical slot 30. The orientation provided to the tool by the engagement of key 50 with the lower guide surface 26 is such that the tool carrier 48 can now be articulated into the side pocket of mandrel 12. The key moves up in slot 30 until abutment shoulder 78 of the key 50 comes in contact with stop shoulder 34. Further upward movement of the wire line tool or pump down equipment 44 results in the plunger 46 remaining stationary and the housing 40 being pulled upward with respect to the plunger 46. Lower surface 66 of the plunger 46 and upper surface 68 of the tool carrier 48 engage to articulate the carrier into the side pocket.

The well tool 56 is landed in side pocket 20 in a conventional manner and the attaching means releases the well tool 56. The kickover tool can now be raised to remove it from the tubing. Upon upward movement of the kickover tool, abutment shoulder 78 again engages stop shoulder 34. A substantial force shears pin 92 of the abutment member 88 permitting the abutment member 88 to swing into recess 70 and permitting chamferred surface 86 to retract key 50 into recess 70. When the tool carrier 48 comes into contact with the upper bore of side pocket mandrel 12, a force is exerted on the tool carrier which causes it to pivot about pivot joint 60, and causes its upper surface 68 to engage the lower surface 66 of the plunger 46 thus slidably moving the plunger with respect to the housing 40 so that the tool carrier 48 once again resumes its aligned and locked position as explained in said aforementioned application. The kickover tool is thus removed from the tubing 10 without the carrier arm 48 dragging against the tubing wall all the way to the surface.

When a well tool is retrieved from the side pocket, a similar operation is followed except that a different attachment is secured to the lower end of the adaptor 54. The attachment is run into a position where it can attach itself to the upper end of a well tool in the side pocket.

From the foregoing it can be seen that the objects of this invention have been attained. An orienting system for a kickover tool has been provided which permits the orienting means to have a single orientation within all side pocket mandrels which may be run in the well tubing even though the kickover tool has only one locator key. When the kickover tool is being lowered through the tubing, it is oriented to prevent its engagement with the side pocket of any side pocket mandrel; but when it is raised in the tubing, it is oriented to be kicked over into the side pocket.

It will be apparent that the relationship of the key 50 and slot 30 are selected relative to the kickover tool and side pocket to permit articulation of the tool carrier into the side pocket. The slot 28 is angularly spaced from slot 30 at any desired relationship which will prevent such articulation. While the slots are shown 180 degrees apart other relationships will obviously prevent the tool carrier from entering the side pocket.

While the kickover tool design of said application 454,727 as modified herein is preferred, other designs may be used. For instance, with this invention it is not necessary to lock the body 40 and tool carrier 48 in aligned position while running in or to prevent movement of the tool carrier except in one direction from aligned position as dictated by shoulders 62 and 64. If the orientation going into the well is say 90° from the side pocket instead of 180° as shown, the side walls of the mandrel hold the tool carrier aligned and it cannot swing into a position to engage the side pocket even if allowed to swing in both directions from aligned position.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A mandrel comprising:

an elongate body, means at opposite ends of said body for connecting said body in a well tubing, said body having a bore extending therethrough, a side pocket in said body opening into said bore, means associated with said side pocket for receiving flow control means in said side pocket, a first orienting means in said bore adapted to orient a kickover tool that articulates in only one angular direction from an aligned position so that the tool cannot articulate into said side pocket of the mandrel on movement of the tool through the mandrel in one direction, and a second orienting means in said bore adapted to orient a kickover tool that articulates in only one angular direction from an aligned position so that the tool can articulate into said side pocket of the mandrel on movement of the tool in the other direction through the mandrel, said second orienting means being oriented a sufficient angular distance from said first orienting means so that a kickover tool that articulates in only one angular direction from an aligned position with one locator key will be oriented in the designated manner.

2. The mandrel of claim 1 wherein the orienting means comprises a sleeve with the first orienting means comprising an upper downwardly directed mule shoe guide surface on said sleeve and the second orienting means comprising a lower upwardly directed mule shoe guide surface on said sleeve.

3. The mandrel of claim 2 wherein from the lowermost extremity of the upper guide surface extends a downwardly directed vertical slot, said downwardly directed vertical slot terminating in a chamfered surface.

4. The mandrel of claim 2 wherein from the uppermost extremity of the lower guide surface extends an upwardly directed vertical slot, said upwardly directed vertical slot terminating in a stop shoulder to engage a key to articulate the kickover tool.

5. A kickover tool for running and retrieving well equipment comprising:

an elongate housing, a plunger slidably carried within said housing, a tool carrier pivotally carried by one of said housing and said plunger, a retractable locator key pivotally carried by the other of said housing and said plunger, means for resiliently urging the projection of said key outward from said housing, an upwardly directed abutment shoulder on said key for engaging a downwardly directed stop shoulder in the well tubing in which the tool is run to articulate the tool, a downwardly directed chamfered surface on said key to permit the key to ride over obstructions as the tool is lowered through the well tubing, a downwardly directed stop shoulder on said key spaced inwardly from said chamfered surface for engaging orienting means located in the well tubing, means for articulating said tool carrier with respect to said housing upon engagement of said abutment shoulder with a downwardly stop shoulder in the well, means carried by said tool carrier for releasably securing thereto the well equipment to be run or retrieved, and means rendering said upwardly directed abutment shoulder ineffective in response to a selected force to permit upward movement of the tool past stop shoulders in the well tubing.

6. The kickover tool of claim 5 wherein a chamfered surface is at the upper projecting extremity of said locator key, and said upwardly directed abutment shoulder is provided by an abutment member secured to the upper portion of said key to a pivot pin and a shear pin.

7. An apparatus for running and retrieving well equipment comprising:

a mandrel including;

an elongate body, means at opposite ends of said body for connecting said body in a well tubing, said body having a bore extending therethrough, a side pocket in said body opening into said bore, means associated with said side pocket for receiving flow control means in said side pocket, a first orienting means in said bore adapted to orient a kickover tool that articulates in only one angular direction from an aligned position so that the tool cannot articulate into said side pocket on movement of the tool through the body in one direction, and a second orienting means in said bore adapted to orient a kickover tool that articulates in only one angular direction from an aligned position so that the tool can articulate into said side pocket on movement of the tool in the other direction through the bore, said second orienting means being oriented a sufficient angular distance from said first orienting means so that a kickover tool that articulates in only one angular direction from an aligned position with one locator key will be oriented in the designated manner;

and a kickover tool including:

an elongate housing, a plunger slidably carried within said housing, a tool carrier pivotally carried by one of said housing and said plunger, a retractable locator key pivotally carried by the other of said housing and said plunger, means for resiliently urging the projection of said key outward from said housing, an upwardly directed abutment shoulder on said key for engaging a downwardly directed stop shoulder in the well tubing in which said housing is run to articulate said tool carrier, a downwardly directed chamfered surface on said key to permit the key to ride over obstructions as said housing is lowered through the well tubing, a downwardly directed stop shoulder on said key spaced inwardly from said chamfered surface for engaging said first orienting means in said bore, means for articulating said tool carrier with respect to said housing upon engagement of said abutment shoulder with a downwardly directed stop shoulder in the well, means carried by said tool carrier for releasably securing thereto the well equipment to be run or retrieved, and means rendering said upwardly directed abutment shoulder ineffective in response to a selected force to permit upward movement of the housing past stop shoulders in the well tubing.

8. The apparatus of claim 7 wherein a chamfered surface is at the upper projecting extremity of said locator key, and the upwardly directed abutment shoulder of said key is provided by an abutment member secured to the upper portion of said key by a pivot pin and a shear pin.

9. The apparatus of claim 7 wherein the orienting means comprises a sleeve with the first orienting means comprising an upper downwardly directed mule shoe guide surface on said sleeve and the second orienting means comprising a lower upwardly directed mule shoe guide surface on said sleeve.

10. The apparatus of claim 9 wherein from the lowermost extremity of the upper guide surface extends a downwardly directed vertical slot, said slot terminating in a chamfered surface.

11. The apparatus of claim 9 wherein from the uppermost extremity of the lower guide surface extends an upwardly directed vertical slot, said upwardly directed vertical slot terminating in a stop shoulder to engage said abutment shoulder of said key to articulate the kickover tool.

12. A side pocket mandrel comprising:

an elongate body having a bore extending therethrough and a side pocket opening into said bore, means in said side pocket for receiving a flow control device, an orienting sleeve in said bore having a pair of longitudinal slots arranged at different orientations;

one of said slots extending from one end of said sleeve to a square shoulder in said sleeve;

the other of said slots extending from the other end of said sleeve to a chamfered shoulder in said sleeve; and guide surfaces on each end of said sleeve inclined toward the juncture of said slots with the ends of said sleeve.

13. A kickover tool comprising:

an elongate housing:

a plunger telescoped in said housing and movable relative thereto;

a tool carrier pivotally joined to one of said housing and said plunger for movement between an aligned position and a kick-over position to one side of said housing;

a key movably carried by the other of said housing and said plunger;

resilient means urging said key toward its extended position;

a surface on said key exterior in said housing facing toward said tool carrier which is chamfered at its outer end and perpendicular to the axis of said housing and said plunger inward of the chamfer;

a shoulder on said key facing away from said tool carrier which is perpendicular to the axis of said housing and said plunger; and means rendering said last mentioned shoulder ineffective upon the application of a selected force thereto.

14. An apparatus for running and retrieving well equipment comprising:

a mandrel including;

an elongate tubular body having a bore extending therethrough and a side pocket opening into said bore, means in said side pocket for receiving well equipment, an orienting sleeve in said bore having a pair of longitudinal slots arranged in different orientations, one of said slots extending from one end of said sleeve to a square shoulder perpendicular to the longitudinal axis of said sleeve, the other of said slots extending from the other end of said sleeve to a chamfered shoulder in said sleeve, and guide surfaces on each end of said sleeve inclined toward the juncture of said slots with the ends of said sleeve;

and a kickover tool including:

an elongate housing, a plunger telescoped in said housing and movable relative thereto, a tool carrier pivotally joined to one of said housing and said plunger for movement between an aligned position and kicked-over position to one side of said housing, a key movably carried by the other of said housing and said plunger, resilient means urging said key toward its extended position, a surface on said key facing toward said tool carrier which is chamfered at its outer end and perpendicular to the axis of said housing and said plunger inward of the chamfer, a shoulder on said key facing away from said tool carrier which is perpendicular to the axis of said housing and said plunger, and means rendering said last mentioned shoulder ineffective upon the application of a selected force thereto.

* * * * *